US008074549B2

(12) United States Patent
Granger

(10) Patent No.: US 8,074,549 B2
(45) Date of Patent: Dec. 13, 2011

(54) DRUM FOR WIPE MATERIAL DISPENSING MACHINE

(76) Inventor: Maurice Granger, St. Priest en Jarez (FR)

( * ) Notice: Subject to any disclaimer, the term of this patent is extended or adjusted under 35 U.S.C. 154(b) by 424 days.

(21) Appl. No.: 12/517,658

(22) PCT Filed: Dec. 18, 2007

(86) PCT No.: PCT/FR2007/052542

§ 371 (c)(1),
(2), (4) Date: Jun. 4, 2009

(87) PCT Pub. No.: WO2008/081145

PCT Pub. Date: Jul. 10, 2008

(65) Prior Publication Data

US 2010/0077896 A1 Apr. 1, 2010

(30) Foreign Application Priority Data

Dec. 22, 2006 (FR) ..... 06 55855

(51) Int. Cl.
*B26D 7/00* (2006.01)

(52) U.S. Cl. ..... 83/649; 83/648; 225/10; 225/16

(58) Field of Classification Search ..... 83/648, 83/649, 331, 335, 650, 337, 339; 225/10, 225/16, 46, 47; 242/564.4; 474/174
See application file for complete search history.

(56) References Cited

U.S. PATENT DOCUMENTS 1,927,976 A * 9/1933 Evans ..... 83/444
2,839,345 A * 6/1958 Engel et al. ..... 225/16
3,393,592 A * 7/1968 De Maredsous ..... 83/207
4,213,363 A * 7/1980 Granger ..... 83/298
4,441,392 A * 4/1984 DeLuca ..... 83/337
4,635,837 A * 1/1987 Granger ..... 225/96
4,846,035 A * 7/1989 Granger ..... 83/337
5,042,351 A * 8/1991 Rosenthal ..... 83/649
5,125,548 A * 6/1992 Perrin et al. ..... 225/39
5,146,830 A * 9/1992 Granger ..... 83/649
5,294,192 A * 3/1994 Omdoll et al. ..... 242/560.1
5,979,284 A * 11/1999 Granger ..... 83/649

(Continued)

FOREIGN PATENT DOCUMENTS

FR 2701016 A1 8/1994

(Continued)

OTHER PUBLICATIONS

International Search Report for PCT/FR2007/052542 dated Apr. 15, 2009.

*Primary Examiner* — Sean Michalski
(74) *Attorney, Agent, or Firm* — Heslin Rothenberg Farley & Mesiti P.C.

(57) ABSTRACT

A drum comprises a longitudinal central core corresponding to a length of the drum and extending from its ends, end discs, a plurality of intermediary discs provided with notches defining a housing zone of a cutting device and one or several sleeves made of an elastomeric material and braced around the discs. The sleeves at the initial state have a diameter substantially greater than a diameter of the drum and a certain degree of elasticity to deformation. A brace pushes and maintains the sleeves at the bottom of the notches causing an elastic deformation of the sleeves which grip the upper edges of the intermediary discs and an end disc producing pleats between consecutive intermediary discs.

5 Claims, 3 Drawing Sheets

U.S. PATENT DOCUMENTS

| | | | | |
|---|---|---|---|---|
| 6,314,850 | B1 | 11/2001 | Morand | |
| 6,450,076 | B1 * | 9/2002 | Granger | 83/334 |
| 6,609,449 | B2 * | 8/2003 | Granger | 83/649 |
| 6,609,450 | B2 * | 8/2003 | Granger | 83/649 |
| 6,684,751 | B2 * | 2/2004 | Kapiloff et al. | 83/649 |
| 6,962,101 | B2 * | 11/2005 | Granger | 83/337 |
| 7,066,070 | B2 * | 6/2006 | Granger et al. | 83/649 |
| 2002/0030075 | A1 * | 3/2002 | Granger | 225/16 |
| 2004/0089127 | A1 * | 5/2004 | Hong | 83/649 |
| 2004/0200332 | A1 * | 10/2004 | Chen | 83/648 |
| 2005/0051008 | A1 * | 3/2005 | Granger | 83/335 |
| 2006/0156889 | A1 * | 7/2006 | Johnson | 83/649 |
| 2006/0266784 | A1 | 11/2006 | Kananen | |

FOREIGN PATENT DOCUMENTS

| | | | |
|---|---|---|---|
| FR | 2723303 | A1 | 2/1996 |

* cited by examiner

DRUM FOR WIPE MATERIAL DISPENSING MACHINE

CROSS REFERENCE TO RELATED APPLICATIONS

This application is a national stage filing under section 371 of International Application No. PCT/FR2007/052542 filed on Dec. 18, 2007, and published in French on Jul. 10, 2008 as WO 2008/081145 and claims priority of French application No. 0655855 filed on Dec. 22, 2006, the entire disclosure of these applications being hereby incorporated herein by reference.

BACKGROUND ART

The invention relates to the technical field of machines with automatic or semi-automatic cutting used to dispense strips of material having a given format or selected format. These wipe dispensing machines have numerous uses for hand wipes, toilet paper and other wipes.

The Applicant holds a large number of patents, granted both in France and internationally, that relate to this type of dispensing machine. In order to make the object of the invention readily understandable, FIG. 1 shows a general dispensing machine of this type. This machine comprises, in a housing (1), a drum (2) that includes a mechanism for cutting (3) a strip of material originating from a reel of material (4). This reel is either hung from support side plate (5) on the housing of the machine in a plane that is perpendicular to the back wall or said reel of material rests on the actual drum itself. The drum has ends that form protruding fingers that rest against and allow centering on the housing's accommodating side plate. To achieve this and in this case, the drum has, over its length and over its peripheral edge, a gripping area that allows the strip of material to be held fast in order to facilitate its unwinding. Alternatively and as shown in FIG. 1, a pressure roller (6) presses against the drum. The gap between them leaves clearance for the strip of material. The drum has parallel intermediate discs with a notch leaving clearance for the blade-holder. This is described in French Patent No. 2701016.

Depending on the quality of the wipe material, which is generally made of cellulose wadding, and its thickness, which varies depending on the particular market (European or American for example), it is necessary to ensure paper retention under optimum conditions. The Applicant has thus proposed designing the drum with means to ensure retention of the strip of material either by using hook-and-loop type strips that are therefore rough or by using sleeves made of an elastomer material arranged along the drum over all or part of its surface, apart from the area through which the cutting blade moves.

This is described, for example, in the Applicant's French Patent No. 8319815/2555975. The latter also makes provision for designing the drum with a plurality of parallel discs, arranged along the longitudinal axis of the drum, on which the strip of material to be cut rests (French Patent No. 2701016).

The proposed solutions have proved satisfactory in a very large number of industrial applications.

There nevertheless remains the problem of changes in the characteristics of the wipe material and also the durability of the elastomer sleeves which have a tendency to lose their ability to adhere to the actual drum and no longer retain the strip of wipe material.

BRIEF SUMMARY OF INVENTION

The Applicant has therefore devoted efforts to finding a satisfactory solution to prolong the usability of the sleeves made of an elastomer material whilst preserving the intrinsic adhesion properties of the elastomer materiel over time.

The solution devised by the invention meets this need simply and practically by making it possible to maintain the elasticity of the sleeves on the drum and preserve the adhesion properties of the wipe materials.

The solution provided by the invention is simple, easy to use and does not require any upgrading of the wipe material dispensing machine likely to incur significant die costs or other investments of this type.

According to a first aspect of the invention, the drum for a wipe material dispensing machine of the type comprising a central longitudinal core that corresponds to the length of the drum and protrudes at its ends so that it can be positioned relative to the accommodating side plates of the housing of the machine, said drum being designed with an end disc having an opening for movement of the blade-holder and, opposite this, another notched end disc with an offset shaped accommodating support for the other end of the blade-holder and, between the end discs of the drum, the latter is designed with a plurality of intermediate discs parallel to each other and with a predetermined pitch, said intermediate discs and the end disc being designed with a notch that defines the area in which the cutting device is housed in order to enable its articulation and swiveling, said drum accommodating a sleeve made of an elastomer material is distinctive in that the drum accommodates one or more sleeves made of an elastomer material that are tensioned around the disc-shaped components of said drum and in that, in its/their original non-stressed state, this or these sleeves have a diameter that is substantially in excess of the diameter of the drum and has/have a certain deformation elasticity and in that it/they comprise one or more means of tensioning the sleeve(s) in order to push and keep it/them in the bottom of the various notches and in that insertion and accommodation of this or these means in the notches causes elastic deformation of the sleeve(s) which grip the upper edges of the intermediate discs and an end disc of the drum, thereby causing the formation of folds between consecutive intermediate discs.

These aspects and others will become apparent from the following description.

BRIEF DESCRIPTION OF DRAWING FIGURES

The object of the present invention is described, merely by way of example, in the accompanying drawings in which.

DETAILED DESCRIPTION

In order that the object of the invention may more readily be understood, the following description is given, merely by way of example, reference being made to the accompanying drawings.

The drum for the wipe material dispensing machine is represented in its entirety by (10). It has a longitudinal central core (10*a*) that corresponds to the length of the drum and protrudes at its ends (10*b*) so that it can be positioned relative to the accommodating side plates of the housing of the machine. In a known manner, this drum has an end disc (10*c*) that has an opening (10*d*) allowing movement of the blade-holder and, at the opposite end, another notched end disc (10*e*) with an offset shaped accommodating support (10*f*) for the other end of the blade-holder. Between the end discs (10*c*-10*e*) of the drum, the latter is designed with a plurality of intermediate discs (10*g*) arranged parallel to each other and spaced apart in accordance with a predetermined pitch.

Figure 1:
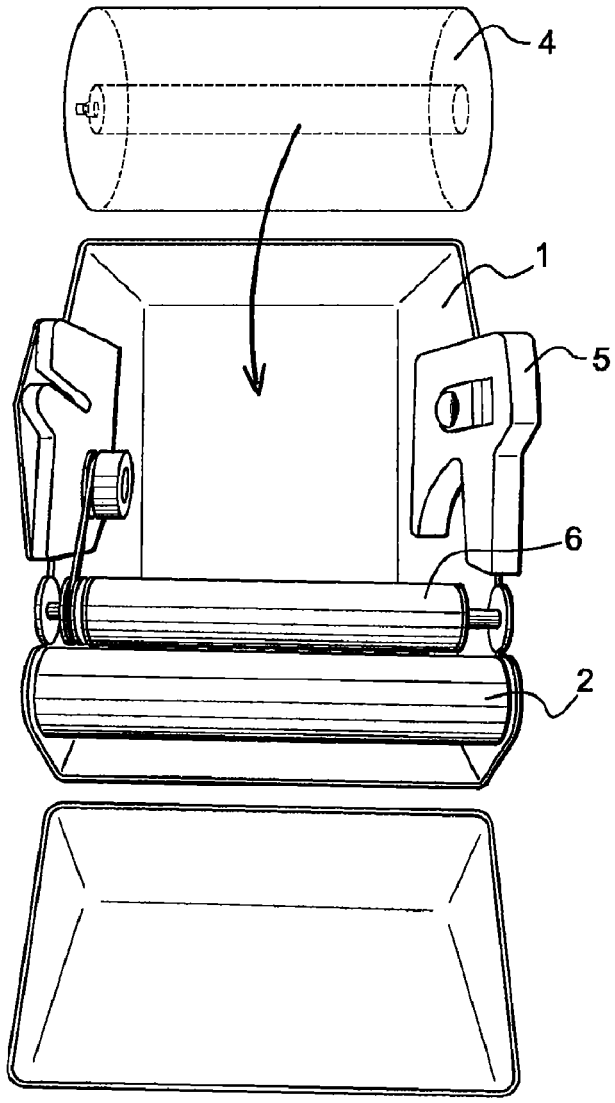
FIG. 1 is a front view showing a dispensing machine according to the prior art.
Figure 2:
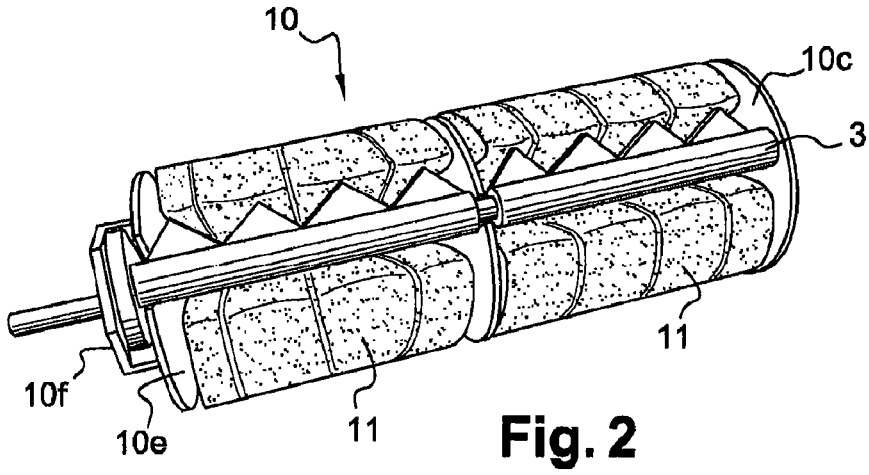
FIG. 2 is a perspective view of the drum according to the invention.
Figure 3:
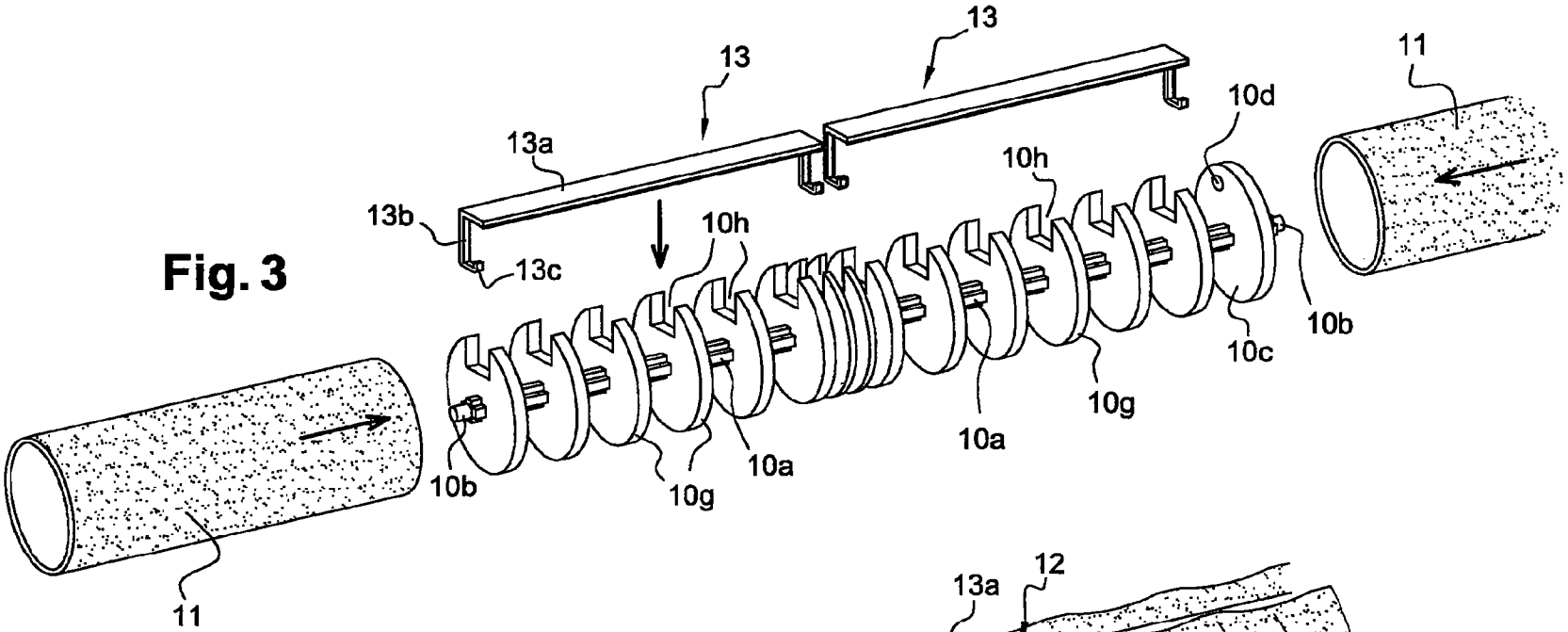
FIG. 3 shows the configuration of the drum in an exploded view before assembly in a first embodiment that uses tensioning of the sleeve(s)—the cutting device is not shown.

According to the invention, the drum is devised to accommodate one or more sleeves (11) made of an elastomer material that are tensioned around the disc shaped component parts of said drum. In its/their original non-stressed state, this or these sleeves have a diameter that is substantially in excess of the diameter of the drum and has/have a certain deformation elasticity. The intermediate discs (10*g*) and the end disc (10*e*) of the drum are thus designed with a square shaped notch (10*h*), all of the notches being in alignment as shown in FIG. 3, for example, and defining the area in which the cutting device is housed (12) and enabling articulation and swiveling of the blade in a known manner and also positioning of means (13) for tensioning the sleeve(s) in order to push and keep it/them in the bottom of the various notches. In order to take into account the length of the roll and also the possible layout of the middle part of the drum to provide a guide flange for a transmission belt linking the drum to a pressure roller, there is provision for the elastomer sleeve to be made in one or two parts that are positioned over the totality of the drum if the latter is not designed with a transmission belt or over the two halves of the length of the drum as shown in the Figures if there is a transmission belt.

According to the invention, means (13) of tensioning the part or parts of the sleeves is intended to press up against the upper exposed part of the latter in order to push it/them against the bottom of notch (10*h*). This downward movement therefore causes elastic deformation of the part or parts of the sleeves which then grip the upper edges of the intermediate discs and one end disc of the drum, thereby causing the formation of folds or ripples between consecutive intermediate discs in order to ensure better retention of the material when there is a pressure roller.

Figure 4:
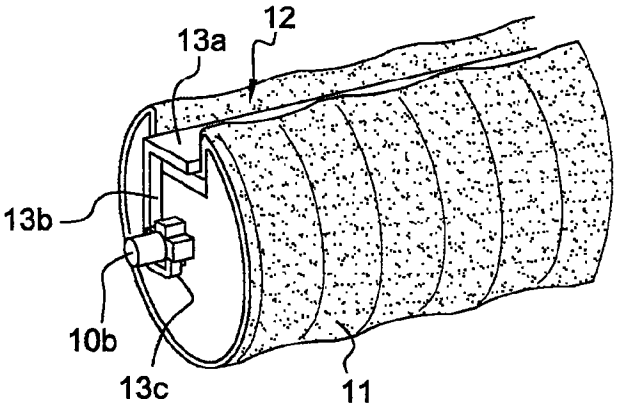
FIG. 4 is a partial perspective view of the drum after assembly.
Figure 5:
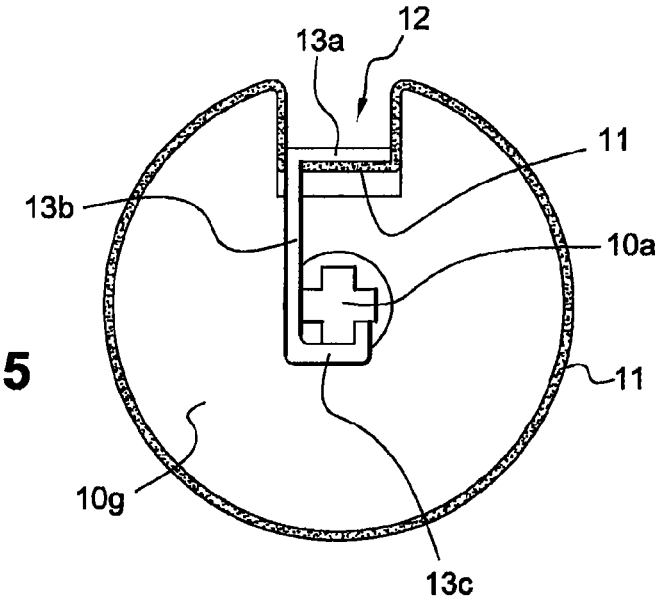
FIG. 5 is an end-on view of the drum.
Figure 6:
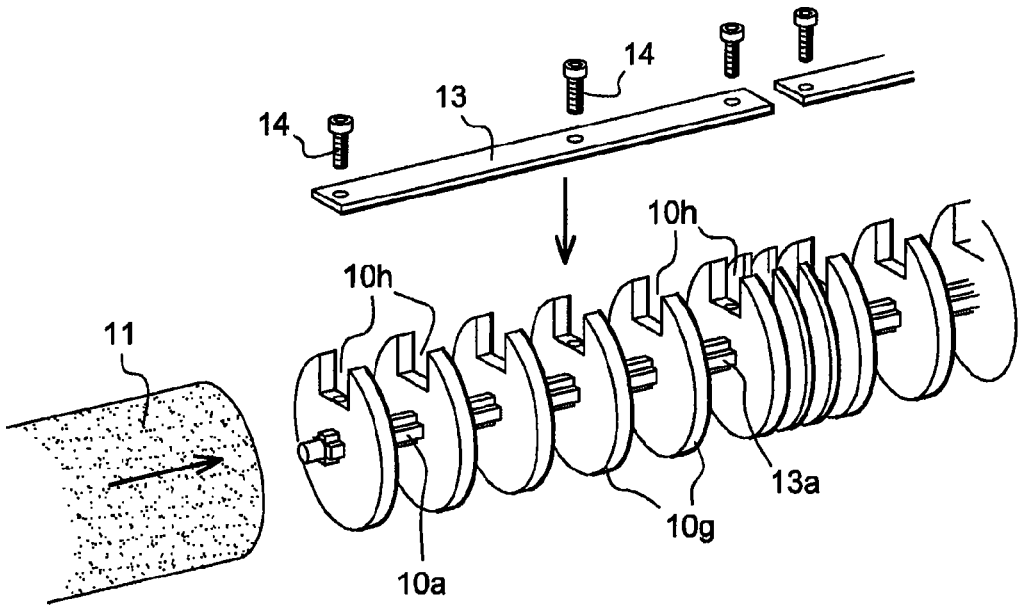
FIG. 6 is an alternative view of the method of fixing by means of tensioning.

Means of tensioning (13) is thus in the form of a short horizontal bar (13*a*) for each sleeve or sleeve part, this flat short bar being inserted into the notches of the above-mentioned disc. The short bar is attached to the drum in two possible ways shown, by way of example, in the drawings. In FIGS. 3, 4 and 5, short bar (13*a*) has, at its ends, prongs (13*b*) with a shaped tip in the form of hooks (13*c*) that fit and attach in the matching shape of the central core of the drum. The core is designed, for instance, with catches which make it possible to clip fasten the short bar. This acts as a U-bolt and can be easily disassembled if needed. In the alternative shown in FIG. 6, short bar (13*a*) is fixed by connecting screws (14) that penetrate into the bottom of the intermediate discs.

Fixing of means of tensioning (13) the sleeves makes it possible to obtain maximum tension with improved hard contact with the strip from the reel of material. The use of means (13) also makes it possible to prevent any electrostatic charging due to contact with the strip of material made of basewad or similar paper.

The service life of the drum is therefore longer and there is no risk of the sleeves becoming detached because they are held in position by being clamped firmly by the short bars. If U-bolt shaped short bars are used, there is no risk of sleeves becoming loose because deliberate action by the operator is needed in order to release them only if there is a requirement to change the sleeves.

The number of U-bolt shaped short bars depends, for example, on the number of sleeves placed on the drum, depending on the latter's characteristics and how it is fitted into the wipe material dispensing machines.

The invention claimed is:

1. A drum for a wipe material dispensing machine comprising: a central longitudinal core that corresponds to a length of the drum and protrudes at core ends so that the core can be positioned relative to accommodating side plates of a housing of the machine, said drum being provided with a first end disc having an opening for movement of a blade holder and, at an opposite end of the drum, a second notched end disc with an offset accommodating support for an other end of the blade-holder and, between the first end discs and the second end disc the drum has a plurality of intermediate discs parallel to each other and with a predetermined pitch, said intermediate discs and the second end disc having notches that defines an area in which the cutting device is housed in order to enable device articulation and swiveling, said drum including one or more sleeves made of an elastomer material that are tensioned around the intermediate discs of said drum and wherein, in an original non-stressed state the one or more sleeves have a diameter that is substantially in excess of a diameter of the drum and have a certain deformation elasticity, and further comprising one or more means of tensioning the one or more sleeve(s) in order to push and keep the one or more sleeves in a bottom of the notches, and wherein insertion and accommodation of the one or more means in the notches causes elastic deformation of the one or more sleeves which grip upper edges of the intermediate discs and an end disc of the drum, thereby causing formation of folds between consecutive intermediate discs.

2. A drum as claimed in claim 1, wherein the means of tensioning comprises a short horizontal bar for each sleeve or sleeve part, the short bar being inserted into the notches, and the short bar being fixed to the drum.

3. A drum as claimed in claim 2, wherein the short bar has, at its ends, prongs with a shaped tip in the form of hooks that fit and attach in a matching shape of the central core of the drum, and the core has catches that enable clip fastening of the short bar that acts as a U-bolt and can be easily disassembled if needed.

4. A drum as claimed in claim 2, wherein the short bar is fixed by connecting screws that penetrate into a bottom of the intermediate discs.

5. A drum as claimed in claim 1, in combination with a pressure roller that pushes against the one or more sleeves of the drum.

* * * * *